US007350301B2

(12) United States Patent
Chung Lee

(10) Patent No.: US 7,350,301 B2
(45) Date of Patent: Apr. 1, 2008

(54) TENSION-ADJUSTING DEVICE FOR A CHAIN IN CHAIN SAW

(76) Inventor: Hsin-Chih Chung Lee, No. 21-8, Shang San Cho Woo, Wuchang-Li, Chungli City, Tao Yuan Hsien (TW)

( * ) Notice: Subject to any disclaimer, the term of this patent is extended or adjusted under 35 U.S.C. 154(b) by 287 days.

(21) Appl. No.: 11/210,843

(22) Filed: Aug. 25, 2005

(65) Prior Publication Data

US 2007/0044629 A1 Mar. 1, 2007

(51) Int. Cl.
*B27B 17/14* (2006.01)

(52) U.S. Cl. ..... 30/386; 83/816

(58) Field of Classification Search ..... 30/385, 30/386, 381, 383; 83/816
See application file for complete search history.

(56) References Cited

U.S. PATENT DOCUMENTS 2,765,821 A * 10/1956 Strunk ..... 30/386
4,129,943 A 12/1978 Bricker
5,491,899 A 2/1996 Schliemann et al.
5,896,670 A * 4/1999 Gibson et al. ..... 30/386
5,983,508 A 11/1999 Sundstrom
6,532,671 B1 * 3/2003 Jong ..... 30/386
6,564,459 B1 * 5/2003 Steinbrueck et al. ..... 30/383
6,782,627 B2 * 8/2004 Hermes et al. ..... 30/386
6,877,233 B1 * 4/2005 Franke ..... 30/386
2002/0124421 A1 9/2002 Hermes et al.

* cited by examiner

*Primary Examiner*—Boyer D. Ashley
*Assistant Examiner*—Omar Flores Sanchez
(74) *Attorney, Agent, or Firm*—Rabin & Berdo, P.C.

(57) ABSTRACT

A tension-adjusting device for a chain in a chain saw comprises an adjusting assembly, a fixing base, a brake disk, a position piece and a fixing piece, wherein the adjusting assembly, the brake disk, the position piece and the fixing piece are locked together on the fixing base by a bolt. The adjusting assembly further comprises a knob, a nut, a fixing member, and an adjusting ring. An operator merely needs to rotate the knob of the adjusting assembly to drive the adjusting ring and the brake disk, such that the position piece can be moved forward and backward, thereby to attain the tension adjustment of chain.

3 Claims, 4 Drawing Sheets

TENSION-ADJUSTING DEVICE FOR A CHAIN IN CHAIN SAW

BACKGROUND OF THE INVENTION

1. Field of the Invention

The present invention relates generally to a tension-adjusting device for a chain in a chain saw without using any auxiliary tool.

2. The Prior Arts

A chain saw is a popular power tool and is generally used in sawing trees or boards. However, after a long-term use, a chain of the chain saw often gets loosed. When the chain is too loose, it may be come off the chain saw during sawing, resulting in an obstacle in operation. Such a situation will also reduce the life of a chain saw. In conventional chain saws, an operator adjusts the tension of chain by using an auxiliary tool to make the chain tensioned again on the sprocket of the chain saw. However, if the chain is too tense, it may be broken and thus produce a serious accident. Therefore, the operator needs to adjust the tension of chain again by using the auxiliary tool to a proper extent. Using an auxiliary tool to adjust the tension of chain is troublesome and time-consuming, and this also greatly reduces the efficiency of sawing. Further, it is inconvenient for the operator to additionally carry the auxiliary tool.

Therefore, it is necessary to propose an improved tension-adjusting device for a chain in a chain saw. Taiwan Patent Publication No. 503,810 discloses a device for adjusting a chain saw, which comprises an adjusting assembly, a driving assembly and a fixing base. The adjusting assembly comprises a dust-proof cover, a driving disk and a knob; the driving assembly comprises a guide piece, a position piece, a brake disk and a toothed disk; and the fixing base comprises a sprocket, a screw and a guide block. By rotating the knob to drive the driving disk, the tension adjustment of chain can be attained. When the driving disk is driven to rotate, the brake disk follows to be rotated simultaneously and thus, the spiral guide rail provided under the brake disk pushes the position piece to move along the guide block to adjust the tension of chain.

However, in the conventional tension-adjusting device for a chain saw, the adjusting assembly and the driving assembly comprise many parts, and the driving disk and the toothed disk have a complicated structure, resulting in assembly and maintenance difficult and thus having higher manufacturing cost.

SUMMARY OF THE INVENTION

The primary objective of the present invention is to provide a tension-adjusting device for a chain in a chain saw without using any auxiliary tool, which has a simpler structure than conventional devices, is easier to be manufactured, assembled and maintained, and thus has a lower manufacturing cost.

In accordance with an aspect of the present invention, there is provided a tension-adjusting device for a chain in a chain saw, which comprises an adjusting assembly, a fixing base, a brake disk, a position piece and a fixing piece, which are locked together on the fixing base by a bolt, in which the adjusting assembly is located at an outside end of the fixing base while the brake disk, the position piece and the fixing piece are located at an inside end of the fixing base. The adjusting assembly and the brake disk are connected and fixed with each other, and the brake disk is engaged with the position piece via guide rails on the brake disk and projections on the position piece, such that the brake disk, when rotated, drives the position piece to move reciprocally and linearly. Then, such movement further drives a guide plate of a chain saw connected to the position piece to move linearly, thus attaining the tension adjustment of chain in the chain saw.

The adjusting assembly further comprises a knob, a nut, a fixing member, and an adjusting ring. The nut is inserted into and engaged with the fixing member, the fixing member is then combined into the knob, and the knob is combined into the adjusting ring. Finally, the adjusting ring is combined with the fixing base. Since the assembling of the above components does not need any auxiliary tool, it is very convenient for assembling and maintenance.

The present invention reduces the number of components, and does not need to produce toothed members, such as the driving disk and the toothed disk as shown in the above conventional device. Therefore, the present invention really simplifies the structure, and assembling and manufacturing process.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
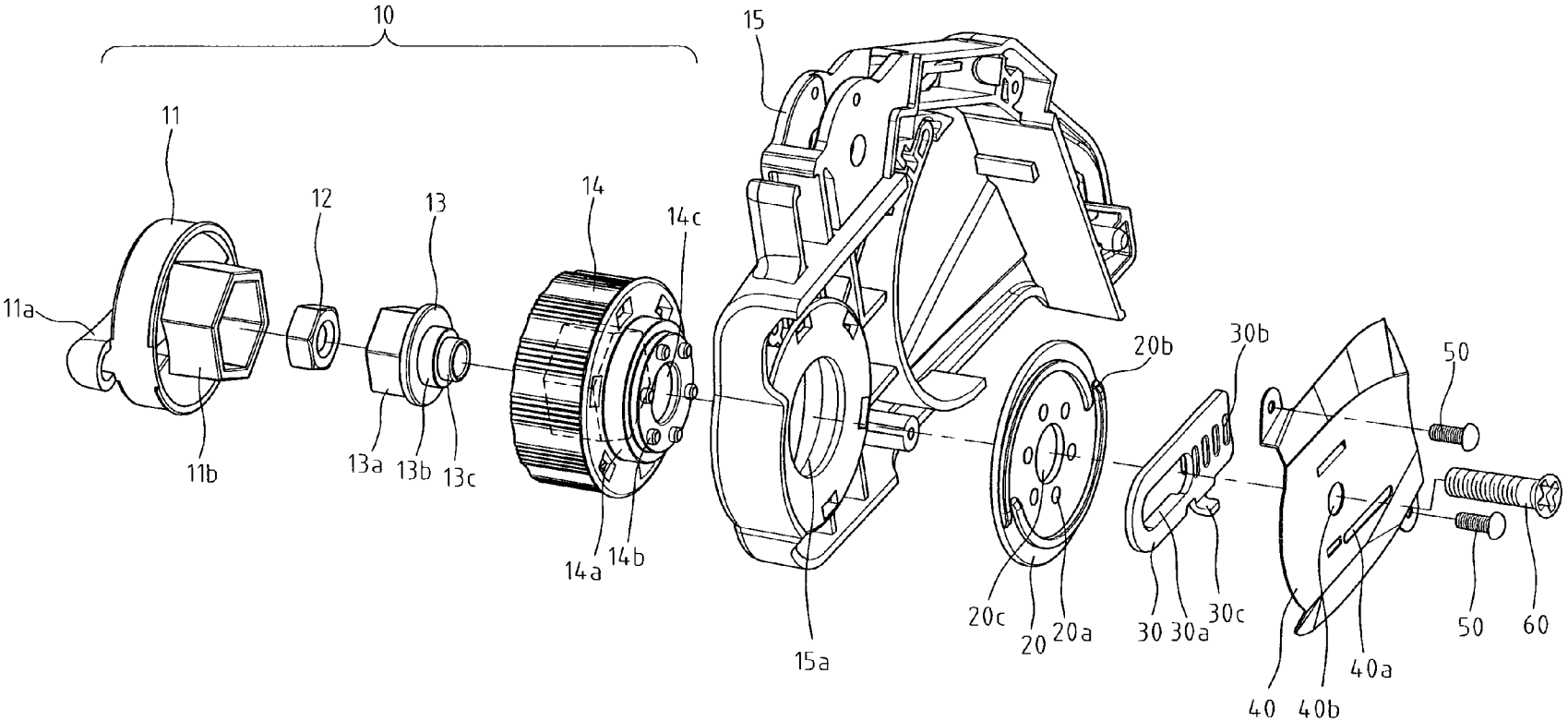
FIG. 1 is an exploded perspective view of a tension-adjusting device for a chain in a chain saw in accordance with the present invention.

First, referring to FIG. 1, a tension-adjusting device for a chain in a chain saw in accordance with the present invention comprises an adjusting assembly 10, a fixing base 15, brake disk 20, a position piece 30 and a fixing piece 40, in which the adjusting assembly 10 further comprises a knob 11, a nut 12, a fixing member 13, and an adjusting ring 14. The adjusting assembly 10, the brake disk 20, the position piece 30 and the fixing piece 40 are locked together on the fixing base 15 by screws 50.

Figure 2:
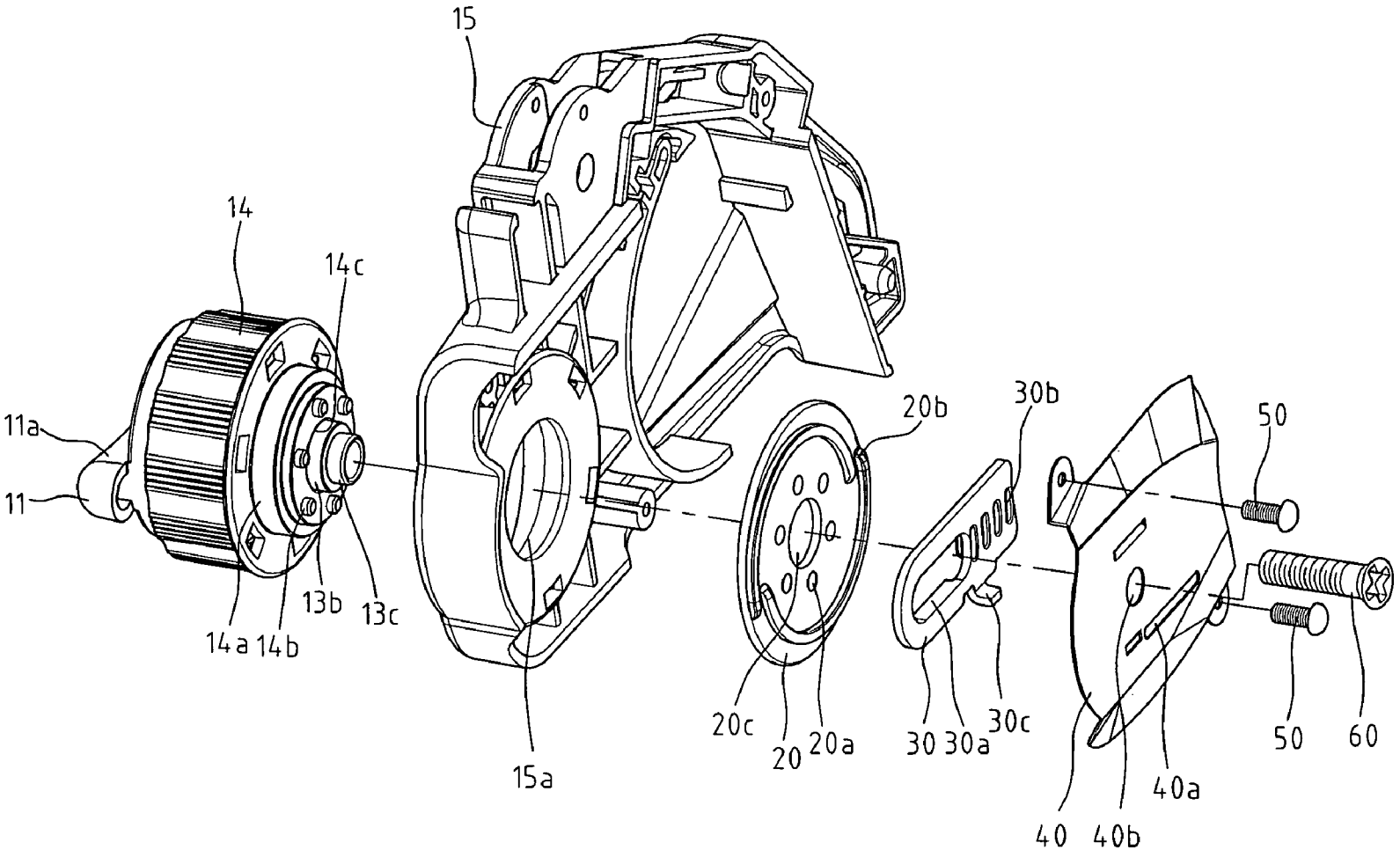
FIG. 2 is a perspective view showing an adjusting assembly of the present invention after assembled.
Figure 3:
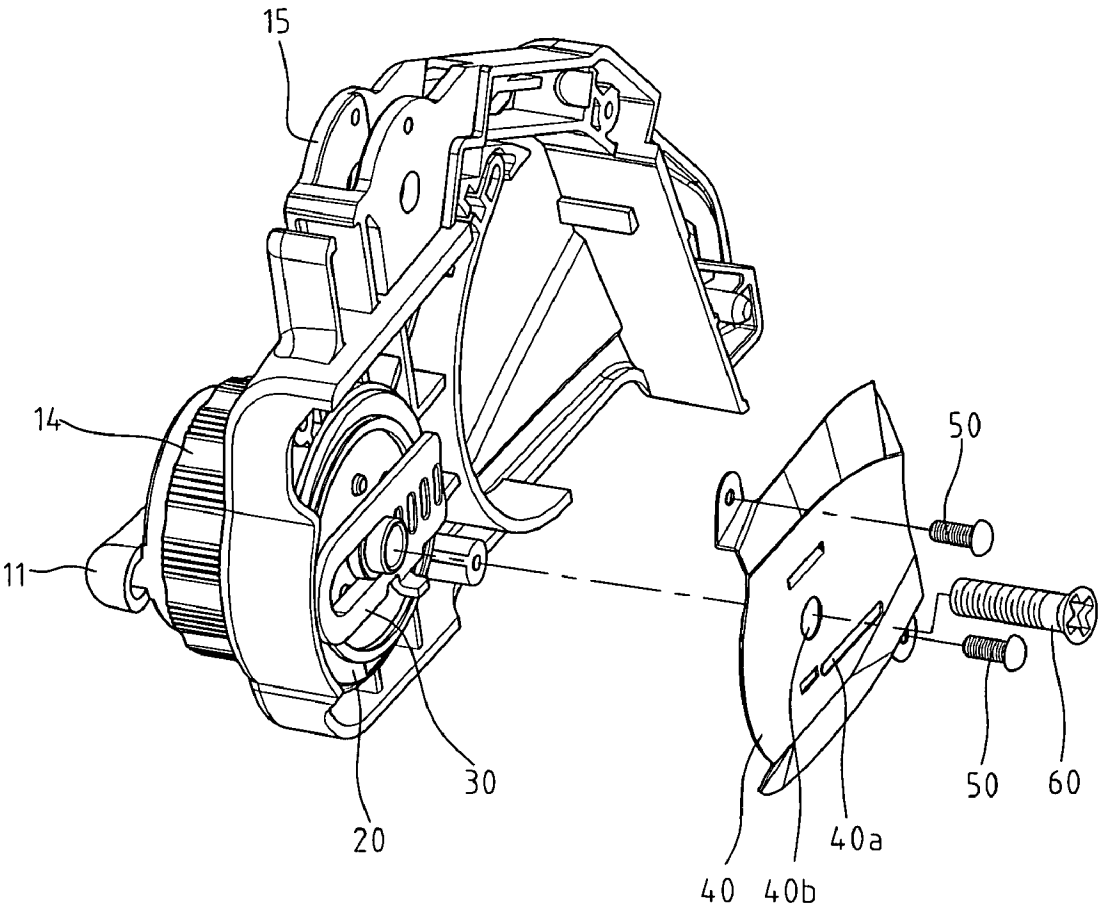
FIG. 3 is a perspective view showing the adjusting assembly, a brake disk and a position piece of the present invention assembled to a fixing base.

Referring to FIGS. 1-3, the structure of the present invention is described in detail as follows. One end of the knob 11 is formed into a disk body having a rotating stem 11*a* thereon; and the other end of the knob 11 is formed into a hollow polyhedron 11*b*. One end of the fixing member 13 is also formed into a hollow polyhedron 13*a* exactly in size received in the hollow polyhedron 11*b* and engaged therewith. As a result, when an operator rotates the knob 11, the knob 11 and the fixing member 13 cannot relatively rotate therebetween. A smaller nut 12 is provided between the knob 11 and the fixing member 13 and the nut 12 is exactly in size received in the hollow polyhedron 13*a* of the fixing member 13. The other end of the fixing member 13 is formed with a cylindrical flange 13*b* and a hollow cylinder 13*c* extends from an end face of the cylindrical flange 13*b*. The cylindrical flange 13*b* can be combined into the adjusting ring 14 and the hollow cylinder 13*c* further penetrates through a center hole 14*c* of the adjusting ring 14.

The adjusting ring 14 is formed into a hollow disk. One end of the adjusting ring 14 is formed into a polygonal recess (not shown), which can exactly receive the hollow polyhedron 11*b* of the knob 11; and the other end thereof is formed into a hollow disk 14*a* with a smaller diameter and projecting from the adjusting ring 14. A plurality of position pins 14*b* (six in FIGS. 1-2) form in a circular manner on an end face of the hollow disk 14*a*. The steps of assembling the adjusting assembly 10 are described as follows. The nut 12 is inserted into the hollow polyhedron 13*a* of the fixing member 13, and then the hollow polyhedron 13*a* of the fixing member 13 is inserted into the hollow polyhedron 11*b* of the knob 11. Subsequently, the hollow polyhedron 11*b* of the knob 11 is inserted into the polygonal recess on one end of the adjusting ring 14 such that the knob 11, the nut 12, the fixing member 13 and the adjusting ring 14 are assembled together. The number and position of the position pins 14*b* of the adjusting ring 14 correspond to those of the pinholes 20*a* of the brake disk 20. Therefore, when the adjusting ring 14 is located at the outside end of the fixing base 15, the hollow disk 14*a* of the adjusting ring 14 penetrates through a circular hole 15*a* into an inside end of the fixing base 15. Since the position pins 14*b* of the hollow disk 14*a* correspond to the pinholes 20*a* of the brake disk 20, the adjusting ring 14 can be engaged with the brake disk 20 by inserting the position pins 14*b* into the pinholes 20*a* of the brake disk 20. Therefore, the adjusting ring 14 and the brake disk 20 cannot rotate with respect to each other.

The other end of the brake disk 20 not contacting with the adjusting ring 14 is provided with a plurality of spiral guide rails 20*b* (two in the drawings). The position piece 30 is provided with a notch 30*a* and a plurality of projections 30*b*. One end of the position piece is provided with a tab 30*c*. Each spiral guide rail 20*b* in its width direction can be properly fitted into the space between two adjacent projections 30*b* such that the spiral guide rail 20*b* can smoothly pass through the space between the two adjacent projections 30*b* on the position piece 30. At the same time, the hollow cylinder 13*c* of the fixing member 13 projects through the shaft hole 20*c* of the brake disk 20 and the notch 30*a* of the position piece 30. Finally, the fixing piece 40 provided with a slot 40*a* is covered on the position piece 30, and thus the tab 30*c* on the position piece 30 passes through the slot 40*a* on the fixing piece 40. The fixing piece 40 is locked to the fixing base 15 by screws 50. Further, a longer bolt 60 penetrates through the hole 40*b* of the fixing piece 40, the notch 30*a* of the position piece 30, the shaft hole 20*c* of the brake disk 20 and the center of the hollow cylinder 13*c* of the fixing member 13, and finally, is screwed into the nut 12 mounted inside the knob 11, such that all the above members are fixed together to complete the assembling of the present invention.

Figure 4B:
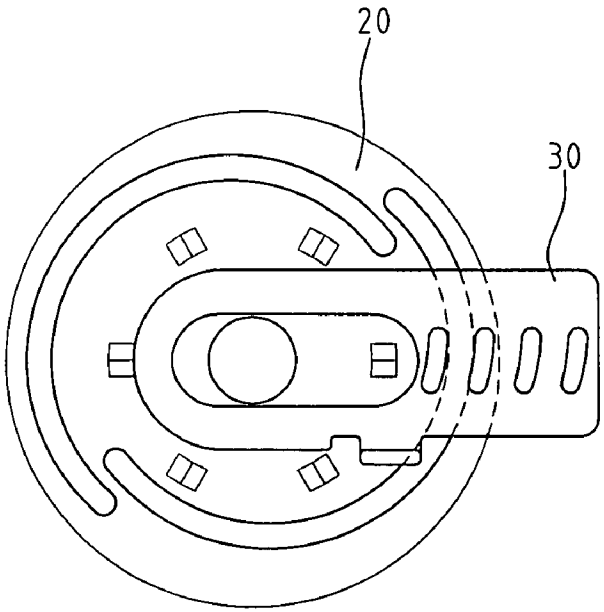
FIGS. 4*a* and 4*b* are plan views showing that the brake disk drives the movement of the position piece.
Figure 4A:
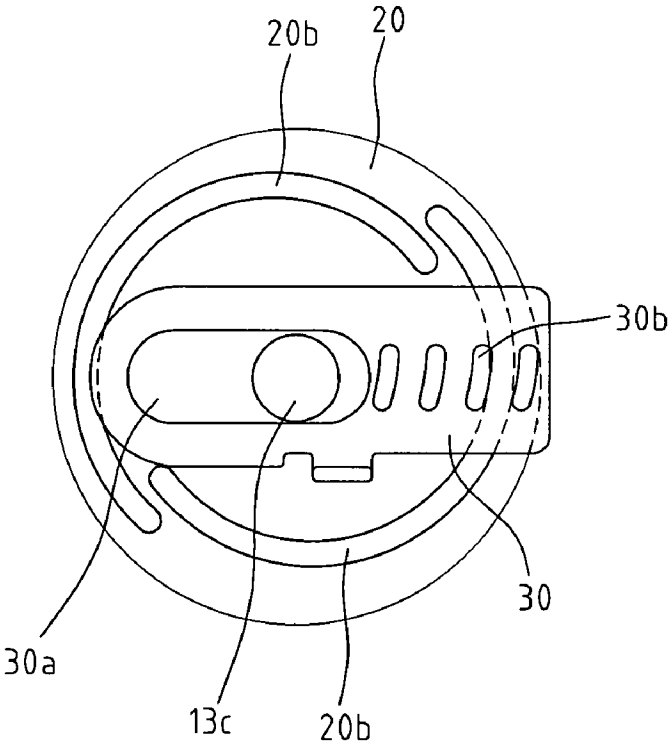

Next, the operation of the present invention is described as follows. The position piece 30 is connected to a guide plate (not shown) used for guiding a chain saw. When the operator intends to adjust the tension of chain, since the knob 11, the nut 12, the fixing member 13, the adjusting ring 14 and the brake disk 20 are assembled together without any relative rotation, the operator merely needs to rotate the stem 11*a* of the knob 11 to drive the adjusting ring 14 and then the brake disk 20 to rotate, and thus, the spiral guide rail 20*b* on one end of the brake disk 20 moves between two adjacent projections 30*b* of the position piece 30, such that the position piece 30 moves forward or backward (see FIGS. 4*a* and 4*b*). In such a way, the tension of chain can be easily adjusted.

The present invention significantly reduces the number of the components. Since the position pins 14*b* of the adjusting ring 14 are engaged with the pinholes 20*a* of the brake disk 20, the present invention eliminates the toothed members, such as the driving disk and the toothed disk in conventional devices. Therefore, the present invention indeed simplifies the structure, and assembling and manufacturing process.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A tension-adjusting device for a chain in a chain saw, comprising an adjusting assembly, a fixing base, a brake disk, a position piece and a fixing piece, wherein the adjusting assembly, the brake disk, the position piece and the fixing piece are locked together on the fixing base by a bolt, the adjusting assembly is located at an outside end of the fixing base while the brake disk, the position piece and the fixing piece are located at an inside end of the fixing base, the adjusting assembly is connected to the brake disk, and the brake disk is engaged with the position piece via spiral guide rails on the brake disk and projections on the position piece whereby each spiral guide rail in its width direction can be properly fitted into the space between two adjacent projections such that the spiral guide rail can smoothly pass through the space between the two adjacent projections on the position piece;

wherein the adjusting assembly comprises a knob, a nut, a fixing member and a adjusting ring, one end of the knob is formed into a hollow polyhedron, one end of the fixing member is also formed into a hollow polyhedron, the adjusting ring is provided with a hollow disk, one end of the hollow disk is formed into a polygonal recess for receiving the hollow polyhedron of the knob whereby the nut is combined into the hollow polyhedron of the fixing member, the hollow polyhedron of the fixing member is combined into the hollow polyhedron of the knob, the hollow polyhedron of the knob is combined into the polygonal recess of the adjusting ring, and the bolt penetrates through the fixing piece, the position piece, the brake disk and the fixing member to be screwed and fixed into the nut.

2. The tension-adjusting device for a chain in a chain saw as claimed in claim 1, wherein an end face of the hollow disk of the adjusting ring is provided with a plurality position pins and the brake disk is provided with a plurality pinholes, the number and position of the pinholes of the brake disk correspond to those of the position pins on the adjusting ring for assembling the adjusting assembly with the brake disk.

3. The tension-adjusting device for a chain in a chain saw as claimed in claim 1, wherein the fixing piece has a slot and the position piece has a tab penetrating through the slot when assembling.

* * * * *